US006783568B1

(12) United States Patent
Bowskill et al.

(10) Patent No.: US 6,783,568 B1
(45) Date of Patent: Aug. 31, 2004

(54) SINTERED STEEL MATERIAL

(75) Inventors: Andrew Keith Bowskill, Coventry (GB); Charles Grant Pumell, Coventry (GB); Iain Robert Whitaker, Coventry (GB)

(73) Assignee: Federal-Mogul Sintered Products Limited, West Midland (GB)

( * ) Notice: Subject to any disclaimer, the term of this patent is extended or adjusted under 35 U.S.C. 154(b) by 0 days.

(21) Appl. No.: 10/031,877

(22) PCT Filed: Jul. 19, 2000

(86) PCT No.: PCT/GB00/02779

§ 371 (c)(1),
(2), (4) Date: Jan. 24, 2002

(87) PCT Pub. No.: WO01/07674

PCT Pub. Date: Feb. 1, 2001

(30) Foreign Application Priority Data

Jul. 27, 1999 (GB) ..... 9917510

(51) Int. Cl.[7] ..... C22C 33/02; C22C 38/22

(52) U.S. Cl. ..... 75/246; 75/255; 419/32; 419/38

(58) Field of Search ..... 419/38, 32; 75/255, 75/246

(56) References Cited

U.S. PATENT DOCUMENTS 5,605,559 A * 2/1997 Unami et al. ..... 75/255

6,123,748 A * 9/2000 Whitaker et al. ..... 75/252

FOREIGN PATENT DOCUMENTS

| | | | |
|---|---|---|---|
| EP | 0312161 | A1 | 4/1989 |
| EP | 0418943 | A1 | 3/1991 |
| GB | 2187757 | A | 9/1987 |
| GB | 2309228 | A | 7/1997 |
| GB | 2312217 | A | 10/1997 |
| WO | 93/02819 | | 2/1993 |

* cited by examiner

*Primary Examiner*—Daniel Jenkins
(74) *Attorney, Agent, or Firm*—Howard & Howard

(57) ABSTRACT

A sintered steel and a method for the manufacture thereof are described, the sintered steel being made by a method comprising the steps of providing a first pre-alloyed steel powder having a composition comprising in weight %: C 0.5–2, Cr 3.5–6, (2 Mo+W) 12–22, V 0.5–5, Co 0–12, Mn 0.1–0.5, Si 0.1–0.6, Fe balance apart from incidental impurities; providing a second pre-alloyed steel powder having a composition comprising in weight %: C 0.3–0.7, Cr 3–5.5, Mo 1–2.5, V 0.3–1.5, W 0–2, Mn 0.1–0.6, Si 0.8–1.2. Fe balance apart from incidental impurities; mixing together from 2 to 50 weight % of the first pre-alloyed steel powder with 98 to 50 weight % of the second pre-alloyed steel powder optionally up to 60 weight % of an iron powder and with carbon powder such that the final carbon content of the matrix of the sintered steel powder is a maximum of 1.1 weight %1; compacting the mixture and sintering to form the sintered steel.

11 Claims, 1 Drawing Sheet

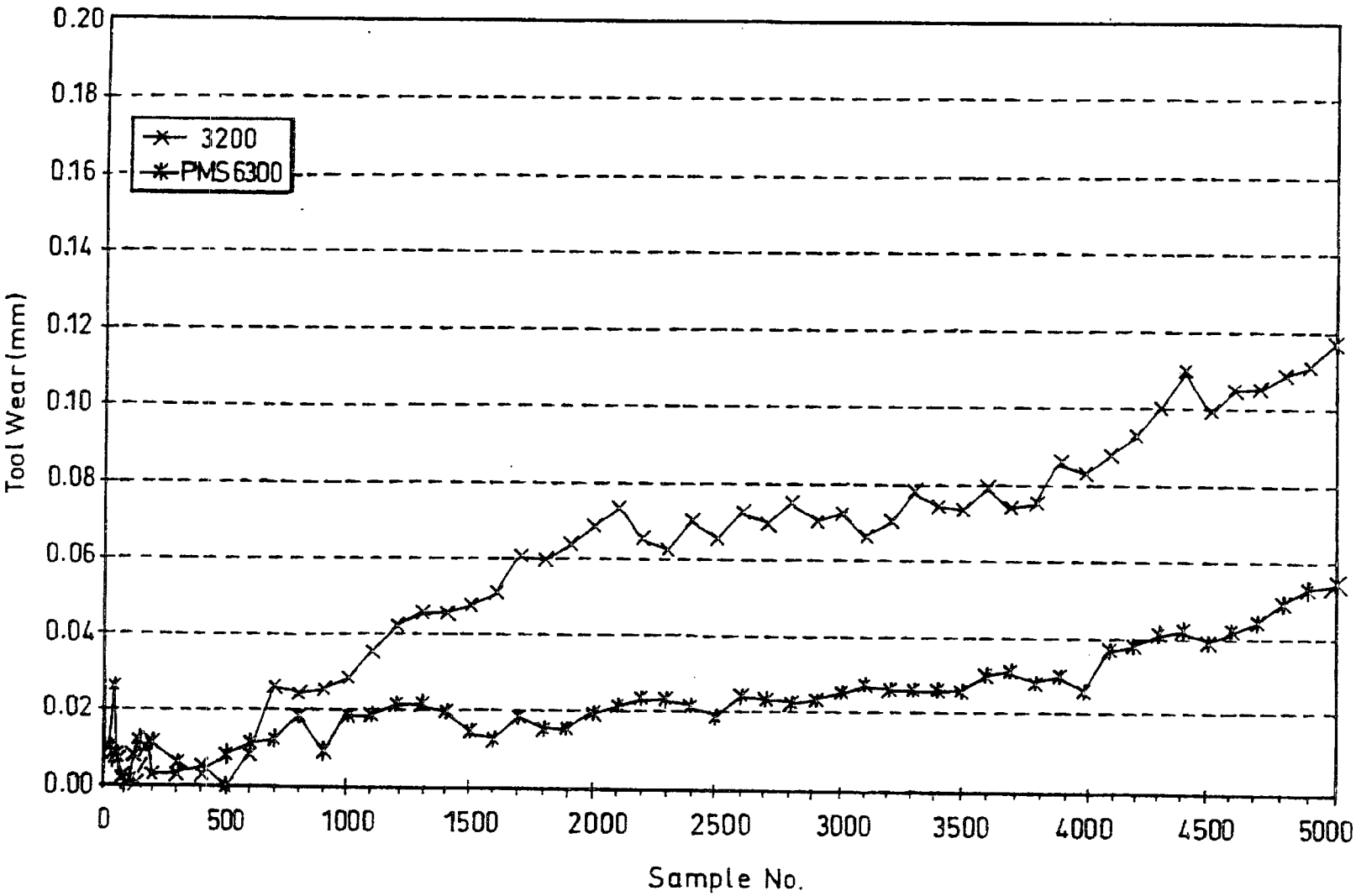
3200
PMS6300
Tool Wear (mm)
0.20
0.18
0.16
0.14
0.12
0.10
0.08
0.06
0.04
0.02
0.00
0
500
1000
1500
2000
2500
3000
3500
4000
4500
5000
Sample No.

SINTERED STEEL MATERIAL

BACKGROUND OF THE INVENTION

1. Technical Field

The present invention relates to a sintered steel material and to a method for the manufacture thereof.

2. Related Art

Sintered steel materials sintered from compacted mixtures comprising a hot working tool steel powder, iron powder and carbon additions in the form of graphite are known from EP-A-0 418 943 of common ownership herewith. The hot working tool steel is generally based upon one or more of those known as AISI H11, H12 and H13. Whilst components manufactured from these materials, such as valve seat inserts for internal combustion engines for example, perform well in operation, they do have some disadvantages associated with the manufacture thereof. In order to achieve the necessary wear resistance in applications such as valve seat inserts it is necessary to provide a certain minimum level of carbon in the structure due to the relatively low level of alloying additions in the hot working tool steels. However, carbon acts as an austenite stabiliser in steels. It is desirable not to have retained austenite in components such as are contemplated for use with these materials since austenite is unstable and if it gradually transforms to an untempered martensite during operation in an engine due to the high temperature environment, component size changes can result and the wear characteristics of the component can become unstable. Therefore, in order to remove austenite, multiple cryogenic and tempering thermal treatments are performed so as to obviate the presence of austenite. However, such multiple thermal treatments are by their very nature time consuming, and there re, expensive in terms of production costs. If the carbon level is restricted to obviate the retained austenite problem, then wear resistance is adversely affected.

EP-A-0 312 161, also of common ownership herewith, describes sintered steels made from compacted and sintered mixtures of high-speed tool steels, iron powder and carbon additions in the form of graphite. The high-speed tool steels contemplated for use are generally based on the M3/2 class. The sintered steels described in EP-A-0 312 161 are generally of lower carbon content than those described in EP-A-0 418 943. This is due to the fact that the alloying addition levels of the principal carbide forming elements of Mo, V and W are greater in these materials and which maintains the required high degree of wear resistance in applications such as valve seat inserts for example. As a result of the lower carbon level, there is less of a problem in removing austenite from the structure after sintering. However, the problem with the alloys described in EP-A-0 312 161 is one of material cost due to the relatively high level of alloying additions.

A further disadvantage of the materials described in EP-A-0 312 161 is their relatively low compressibility due to their relatively high alloying content and consequently higher work-hardening rate.

SUMMARY OF THE INVENTION

It is an object of the I)resent invention to provide a sintered steel material which is easier and more economic to manufacture, lower in material cost than other prior art materials whilst retaining a comparable level of performance in applications such as valve seat inserts for internal combustion engines for example. However, these criteria apply also to any applications requiring resistance to abrasive wear, and resistance to wear at elevated temperatures.

DETAILED DESCRIPTION

According to a first aspect of the present invention, there is provided a method for the manufacture of a material by a powder metallurgy route, the method comprising the steps of providing a first pre-alloyed steel powder having a composition comprising in weight %: C 0.5–2, Cr 3.5–6, (2Mo+W) 12–22, V 0.5–5, Co 0–12, Mn 0.1–0.5, Si 0.1–0.6, Fe balance apart from incidental impurities; providing a second pre-alloyed steel powder having a composition comprising in weight %: C 0.3–0.7, Cr 3–5.5, Mo 1–2.5, V 0.3–1.5, W 0–2, Mn 0.1–0.6, Si 0.8–1.2, Fe balance apart from incidental impurities; mixing together from 2 to 50 weight of the first pre-alloyed steel powder with 98 to 50 weight % of the second pre-alloyed steel powder, optionally up to 60 weight % of an iron powder and with carbon powder such that the final carbon content of the matrix of the sintered steel powder is a maximum of 1.1 weight %; compacting said mixture and sintering to form said sintered steel.

The maximum content of the first pre-alloyed steel powder is 50 wt %. However, this maximum is set by the economic advantage to be gained and it is preferred that the maximum content of the first pre-alloyed steel powder is 30 wt %.

A more preferred content of the first pre-alloyed steel powder is 5 to 20 wt %.

A preferred composition of the first pre-alloyed steel powder is in weight %: C 0.7–1.1; Cr 3.5–4.5; Mo 4.5–6.5; V 1.5–3.5; W 5.5–7; Mn 0–0.4; Si 0–0.4; Fe balance apart from incidental impurities.

Preferably, the content of iron powder is a minimum of 5 wt %.

More preferably, the content of iron powder in the mixture is from 10 to 50 wt %. The iron powder, for the purposes of the present invention is defined as an iron powder which has less than 1 wt % maximum of alloying additions therein and is substantially carbon free. If more than 60 wt % of iron powder is incorporated in the sintered steel, the wear resistance and thermal softening resistance of the product deteriorate.

Part of the total carbon content of the final sintered steel may be added as carbon powder in the form of graphite for example :to the initial powder mixture prior to compaction to form the initial un-sintered "green" compact. The carbon aids compaction by acting as a powder and die lubricant. Only sufficient carbon is added so as to produce a maximum carbon content of 1.1 wt % in the finished sintered ferrous matrix. However, in some embodiments of sintered steels according to the present invention, the total carbon content may be below this level as adequate wear resistance is provided by the regions in the sintered matrix constituted by the first pre-alloyed steel powder. These regions are rich in carbides formed from alloying constituents comprising principally Cr, Mo, V and W.

The microstructure of the sintered steels formed according to the method of the present invention comprises a matrix formed by regions derived from the second steel powder which regions comprise tempered martensite with a fine distribution of carbide precipitates and regions derived from the iron powder when present, comprising pearlite, occasional ferrite and bainite transition zones with the steel martensite regions. The matrix further includes a distribution of tempered martensite regions including spheroidal alloy carbide precipitates derived from the first alloy steel powder randomly dispersed throughout the matrix. The prior particle boundaries are well diffused as a result of the sintering step.

The structure of the sintered steel according to the present invention endows the material with good wear resistance by virtue of the dispersion of hard, alloy carbide containing particles from the first pre-alloyed steel powder distributed throughout the matrix. Thus, the wear properties are maintained whilst maintaining a relatively low overall carbon content which is beneficial in eliminating retained austenite. Furthermore, material costs are reduced due to a relatively low content of the first pre-alloyed steel powder which contains more of the expensive alloying elements.

According to a second aspect of the present invention, there is provided an article made by the second aspect of the present invention.

Articles according to the second aspect of the present invention may include components for internal combustion engines comprising valve seat inserts, tappets, cam followers for example. Other articles may include general engineering components requiring good wear resistance and include, for example, impeller and stator components for pumps.

The method of the present invention may also include the addition of die lubricant wax to the powder mixture, the wax being burnt off during the sintering cycle.

Articles made from the material and by the method of the present invention may be infiltrated with copper or a copper alloy for example during the sintering step or as a separate post-sintering operation. Infiltration fills the residual porosity with the copper material and effectively produces a near full-density material. Infiltration endows the articles so produced with improved hot wear resistance due to the lubricating effect of the copper infiltrant and also gives improved thermal conductivity enabling articles such as valve seat inserts, for example, to operate at lower temperatures in any given engine application. Infiltration also aids the machining of the component where the dimensional precision of the final article shape requires this. Infiltration of the matrix will generate a copper or copper alloy constituent in the range from 9 to 20 wt % of the overall composition, depending upon the degree of porosity in the pre-infiltrated matrix.

Alternatively to infiltration, the initial powder mixture may optionally be provided with an addition of up to 10 wt % of copper or copper alloy which melts during the sintering step to occupy some proportion of the residual porosity of the material. Where copper is added to the initial powder mixture, this may preferably be in the range from 2 to 6 wt %.

Additions of solid lubricant materials such as molybdenum disulphide may be added to give a degree of enhanced wear resistance or lower rubbing friction in use.

Additions of machining aids such as particles of manganese sulphide, for example, may also be added to assist machinability.

For optimum production efficiency and economy of manufacture, the green compacts may preferably be sintered in conventional continuous conveying-type furnaces such as walking beam or mesh-belt conveyor furnaces under a continuous flowing reducing atmosphere such as a hydrogen/nitrogen mixture, for example, which is at or slightly above atmospheric ambient pressure so as to exclude air from the furnace by providing a net outflow of the protective gas from the furnace.

In order that the present invention may be more fully understood, examples will now be described by way of illustration only. The drawing shows a graph of tool wear against the number of articles machined during machinability trials.

Samples of sintered steels according to the present invention were prepared and tested for compressive strength and wear resistance. Samples of comparative materials according to the prior art as described in EP-A-0 312 161 (samples coded 3200) and according to EP-A-0 418 943 (samples coded 6200) were also prepared and were infiltrated with copper.

The formulations of the steel component of 3200 and 6200 materials are given in Table 1 below.

TABLE 1

| | M3/2 (wt %) | H13 (wt %) | Fe (wt %) | Graphite (wt %) | Lubricant (wt %) |
|---|---|---|---|---|---|
| 3200 | 49.75 | 0 | 49.75 | 0.5 | 0.75 |
| 6200 | 0 | 54.2 | 45.07 | 0.73 | 0.75 |

The nominal overall compositions of the 3200 and 6200 samples in wt % are given in Table 2 below.

TABLE 2

| | C | Si | Mn | Cr | Mo | W | V | Cu |
|---|---|---|---|---|---|---|---|---|
| 3200 | 0.9 | — | — | 1.75 | 2.5 | 3 | 1.5 | 16 |
| 6200 | 0.95 | 0.55 | 0.35 | 2.55 | 0.65 | — | 0.5 | 15 |

The compositions of the M3/2 and H13 steel powder constituents of the 3200 and 6200 samples are given in Tables 3 and 4 below. The M3/2 steel powder corresponds to the "first pre-alloyed steel powder" in the Examples according to the present invention below and the H13 steel powder corresponds to the "second pre-alloyed steel powder" in the Examples below.

TABLE 3

(M3/2)

| | Spec. Range | | |
|---|---|---|---|
| | Min | Max | Typical |
| C | 0.95 | 1.05 | 1.04 |
| Cr | 3.85 | 4.2 | 4.17 |
| Mo | 5.5 | 6.2 | 5.75 |
| V | 3.1 | 3.4 | 3.26 |
| W | 5.5 | 6.2 | 5.89 |
| Co | | 0.7 | 0.45 |
| Ni | | 0.4 | 0.23 |
| Cu | | 0.2 | 0.17 |
| Mn | | 0.4 | 0.22 |
| Si | | 0.5 | 0.43 |
| Fe | Balance | | Bal. |

TABLE 4

(H13)

| | Spec. Range | | |
|---|---|---|---|
| | Min | Max | Typical |
| C | 0.35 | 0.45 | 0.38 |
| Cr | 4.75 | 5.25 | 4.78 |
| Mo | 1.25 | 1.75 | 1.36 |
| V | 0.9 | 1.1 | 0.96 |
| W | | 0.4 | 0.13 |
| Co | | 0.6 | 0.05 |
| Ni | | 0.4 | 0.18 |
| Cu | | 0.4 | 0.14 |

TABLE 4-continued

| | (H13) | | |
|---|---|---|---|
| | Spec. Range | | |
| | Min | Max | Typical |
| Mn | | 0.4 | 0.2 |
| Si | 0.85 | 1.15 | 1.06 |
| Fe | Balance | | Bal. |

EXAMPLE 1

A first pre-alloyed steel powder and a second pre-alloyed steel powder were mixed in the proportion one part of the first alloy powder to nine parts of the second alloy powder, with 4 wt % of −300 B.S. mesh copper powder, 3.5 wt % molybdenum disulphide powder and graphite powder intended to achieve a final carbon content of 0.9 wt %. To this was added 0.75 wt % of a lubricant wax to act as a pressing and die lubricant. The powders were mixed for 30 minutes in a Y-cone rotating mixer. Valve seat inserts were pressed at a pressure of 770 MPa. The pressed green bodies were then sintered in a hydrogen and nitrogen atmosphere at 1110° C. for 30 minutes. The articles were cryogenically treated for 20 minutes at −120° C. and tempered at 650° C. for 1 hour in a nitrogen atmosphere.

EXAMPLE 2

A first pre-alloyed steel powder was mixed with a second pre-alloyed steel powder and Atomet 28 (trade mark) iron powder so that the final mixture comprised 15% of the first powder, 39.45% of the second powder and 45% of the iron powder. Graphite powder was added to achieve a final carbon content of 0.9 wt %. To this was added 0.75 wt % of a lubricant wax to act as a pressing and die lubricant. The powders were mixed for 30 minutes in a Y-cone rotating mixer. Wear test pieces and valve seat inserts were pressed at a pressure of 770 MPa. The pressed green bodies were then stacked with pressed components of a copper infiltrant powder. The articles were then simultaneously sintered and infiltrated in a hydrogen and nitrogen atmosphere at 1110° C. for 30 minutes. The articles were cryogenically treated for 20 minutes at −120° C. and tempered at 625° C. for 2 hours.

EXAMPLE 3

A first pre-alloyed steel powder was mixed with a second pre-alloyed steel powder and Atomet 28 (trade mark) iron powder so that the final mixture comprised 10% of the first powder, 43.95% of the second powder and 45% of the iron powder. Graphite powder was added to achieve a final carbon content of 0.9 wt % in the sintered material. To this was added 0.75 wt % of a lubricant wax to act as a pressing and die lubricant. The powders were mixed for 30 minutes in a Y-cone rotating mixer. Wear test pieces and valve seat inserts were pressed at a pressure of 770 MPa. The pressed green bodies were then stacked with pressed components of a copper infiltrant powder. The articles were then simultaneously sintered and infiltrated in a hydrogen and nitrogen atmosphere at 1110° C. for 30 minutes. The articles were cryogenically treated for 20 minutes at −−120° C. and tempered at 600° C. for 2 hours.

EXAMPLE 4

A first pre-alloyed steel powder was mixed with a second pre-alloyed steel powder and Atomet 28 (trade mark) iron powder so that the final mixture comprised 5% of the first powder, 49.35% of the second powder and 45% of the iron powder. Graphite powder was added to achieve a final carbon content of 0.9 wt %. To this was added 0.75 wt % of a lubricant wax to act as a pressing and die lubricant. The powders were mixed for 30 minutes in a Y-cone rotating mixer. Wear test pieces and valve seat inserts were pressed at a pressure of 770 MPa. The pressed green bodies were then stacked with pressed components of a copper infiltrant powder. The articles were then simultaneously sintered and infiltrated in a hydrogen and nitrogen atmosphere at 1110° C. for 30 minutes. The articles were cryogenically treated for 20 minutes at −120° C. and tempered at $_{625}$° C. for 2 hours. Mechanical property data for samples for Examples 3 and 4 are shown in Table 5 below, compared with 3200 and 6200 comparative examples described above. Table 6 shows comparative wear resistance measured by the block-on-ring technique according to ASTM G77-93.

TABLE 5

| | (0.2% compressive proof stress - Mpa) | | |
|---|---|---|---|
| | RT | 300° C. | 500° C. |
| Example 3 | 1143 | 1048 | 776 |
| Example 4 | 1141 | 928 | 687 |
| 3200 | 1090 | 860 | 850 |
| 6200 | 1450 | 1120 | 850 |

TABLE 6

| Material | Wear Volume ($mm^3$) |
|---|---|
| Example 2 | 1.6 |
| Example 3 | 2.1 |
| Example 4 | 2.5 |

Machined valve seat inserts made by the method used for Examples 1 and 4 above were fitted in the exhaust positions of a 2.0 liter unleaded gasoline automotive engine alongside 6200 material valve seats for comparison. The engine was run for 180 hours according to an endurance cycle under full load at 6000 rpm.

At the completion of the test the wear on the valve seat inserts was measured. The results are set out in Table 7 below which shows valve seat insert wear ($\mu$m) after 180 hours endurance test.

TABLE 7

| Material | Valve seat insert wear ($\mu$m) |
|---|---|
| Example 1 | 37 |
| Example 4 | 22 |
| 6200 | 59 |

Table 8 below ranks the comparative cost of the steel portion of some of the materials according to the present invention, as well as the steel portions of 3200 and 6200 for comparison.

TABLE 8

| Material | Cost rank |
|---|---|
| 6200 | Base line |
| Example 4 | Base line |

TABLE 8-continued

| Material | Cost rank |
|---|---|
| Example 3 | Plus 2% |
| Example 2 | Plus 4% |
| 3200 | Plus 9% |

In the case of Example 1 the high raw material cost of the steel matrix is offset by the lower processing cost of the non-infiltrated product.

Machinability trials on valve seat inserts made according to Example 3 (but with a 625° C. tempering temperature) and 3200 comparative material were carried out. The trials were carried out on an existing production facility for a known vehicle valve seat insert.

The production conditions were a cutting speed of 271 m/min; a feed rate of 0.046 mm/rev; a cubic boron nitride cutting tool of SPUN 090308 tip type and a coolant of Quaker oil at 8% concentration.

The drawing shows a graph of tool wear in mm VS number of parts machined for each material.

As may be seen from the drawing, the maximum tool wear for material made by the method of the present invention is much less than 50% of that for the known 3200 material at 5000 samples machined. Thus, the material and articles according to the present invention is clearly more economic to produce in terms of material cost and in terms of production costs.

As hereinbefore described, materials and products according to the prior art as described in EP-A-0 418 943 and EP-A-0 312 161 as well as in materials and products according to the present invention can have a content of retained austenite in the matrix microstructure after sintering. In the more highly alloyed, more expensive materials according to EP-A-0 312 161, this retained austenite is easily removed by a single cryogenic and temper sequence. Products according to EP-A-0 418 943, however, require multiple tempering and cryogenic heat treatment sequences to remove retained austenite and to temper martensite formed therefrom. It is an advantage of the material and method of the present invention that a simple single cryogenic and temper sequence is again sufficient to remove retained austenite. This is believed to be attributable to the reduced carbon level used in the second pre-alloyed steel powder which acts to destabilise the austenite.

Furthermore, the cost of the materials according to the present invention are lower than the highly alloyed 3200 material as may be seen from table 8.

What is claimed is:

1. A method of manufacturing a sintered steel material comprising the steps of:

providing a first pre-alloyed steel powder having a composition comprising in weight %: C 0.5–2, Cr 3.5–6, (2Mo+W) 12–22, V 0.5–5, Co 0–12, Mn 0.1–0.5, Si 0.1–0.6, Fe balance apart from incidental impurities;

providing a second pre-alloyed steel powder having a composition comprising in weight %: C 0.3–0.7, Cr 3–5.5, Mo 1–2.5, V 0.3–1.5, W 0–2, Mn 0.1–0.6, Si 0.8–1.2, Fe balance apart from incidental impurities;

mixing together from 2 to 30 weight % of the first pre-alloyed steel powder with the second pre-alloyed steel powder, with 10 to 60 weight % of an iron powder, and with carbon powder to yield a powder mixture;

compacting and sintering the mixture to form the sintered steel material; and wherein the resultant sintered steel material has a ferrous matrix with a maximum total carbon content of 1.1 weight %.

2. A method according to claim 1 wherein the content of the first pre-alloyed steel powder in the mixture is 5 to 20 wt %.

3. A method according to claim 1 wherein the composition of the first pre-alloyed steel powder lies in the ranges in weight %: C 0.7–1.1; Cr 3.5–4.5; Mo 4.5–6.5; V 1.5–3.5; W 5.5–7; Mn 0–0–4; Si 0–0.4; Fe balance apart from incidental impurities.

4. A method according to claim 1 wherein the iron powder content lies in the range from 10 to 50 wt %.

5. A method according to claim 1 including the step of infiltrating residual porosity with a copper material during the sintering step.

6. The method according to claim 1 including adding copper powder to the powder mix in the range from 2 to 10 weight %.

7. The method according to claim 1 including adding a solid lubricant to the powder mix.

8. The method according to claim 1 including adding machinability-enhancing particles to the powder mix.

9. A method according to claim 8 wherein the machinability-enhancing particles comprise manganese sulphide.

10. A sintered steel material comprising:

a compacted and sintered mixture comprising;

a first pre-alloyed steel powder used in an amount of from 2 to 30 weight % and having a composition comprising in weight %: C 0.5–2, Cr 3.5–6, (2Mo+W) 12–22, V 0.5–5, Co 0–12, Mn 0.1–0.5, Si 0.1–0.6, Fe balance apart from incidental impunities, a second pre-alloyed steel powder having a composition comprising in weight %: C 0.3–0.7, Cr 3–5.5, Mo 1–2.5, V 0.3–1.5, W 0–2, Mn 0.1–0.6, Si 0.8–1.2;

10 to 60 weight % of an iron powder; and carbon powder, wherein the sintered steel material has a ferrous matrix with a maximum total carbon content of 1.1 weight % and is formed by regions derived from the second steel powder, which regions comprise tempered martensite with a fine distribution of carbide precipitates and regions derived from the iron powder when present, comprising pearlite, occasional ferrite and bainite transition zones with the steel martensite regions, the matrix further including a distribution of tempered martensite regions including spheroidal alloy carbide precipitates derived from the first alloy steel powder randomly dispersed throughout the matrix.

11. An article made of a compacted and sintered steel material mixture comprising:

a first pre-alloyed steel powder in an amount of from 2 to 30 weight % and having a composition comprising in weight %: C 0.5–2, Cr 3.5–6, (2Mo+W) 12–22, V 0.5–5, Co 0–12, Mn 0.1–0.5, Si 0.1–0.6, Fe balance apart from incidental impurities, a second pre-alloyed steel powder having a composition comprising in weight %: C 0.3–0.7, Cr 3–5.5, Mo 1–2.5, V 0.3–1.5, W 0–2, 0. 1–0.6, Si 0.8–1.2;

10 to 60 weight % of an iron powder; and carbon powder, wherein the sintered steel material has a ferrous matrix with a maximum total carbon content of 1.1 weight % and is formed by regions derived from the second steel powder with regions comprise tempered martensite, which a fine distribution of carbide precipitates and regions derived from the iron powder when present, comprising pearlite, occasional ferrite and bainite transition zones with the steel martensite regions, the matrix further including a distribution of tempered martensite regions including spheroidal alloy carbide precipitates derived from the first alloy steel powder randomly dispersed throughout the matrix.

* * * * *

UNITED STATES PATENT AND TRADEMARK OFFICE

CERTIFICATE OF CORRECTION

PATENT NO. : 6,783,568 B1 
DATED : August 31, 2004
INVENTOR(S) : Andrew Keith Bowskill et al.

It is certified that error appears in the above-identified patent and that said Letters Patent is hereby corrected as shown below:

Column 8,
Line 63, after "W 0-2," delete "0. 1-0.6," and insert therein -- Mn 0.1-0.6, --

Signed and Sealed this

Twenty-eighth Day of June, 2005

JON W. DUDAS
*Director of the United States Patent and Trademark Office*